US005367280A

United States Patent [19]

Thiel et al.

[11] Patent Number: 5,367,280

[45] Date of Patent: Nov. 22, 1994

[54] THICK FILM FUSE AND METHOD FOR ITS MANUFACTURE

[75] Inventors: Egon Thiel, Altdorf; Theo Grieb; Konrad Walch, both of Landshut, all of Germany

[73] Assignee: Roederstein Spezialfabriken fuer Bauelemente der Elektronik und Kondensatoren der Starkstromtechnik GmbH, Landshut, Germany

[21] Appl. No.: 88,542

[22] Filed: Jul. 7, 1993

[30] Foreign Application Priority Data

Jul. 7, 1992 [DE] Germany ..... 4222278

[51] Int. Cl.[5] ..... H01H 85/04

[52] U.S. Cl. ..... 337/297; 29/623

[58] Field of Search ..... 337/297; 29/623

[56] References Cited

U.S. PATENT DOCUMENTS 4,626,818 12/1986 Hilgers ..... 337/297

FOREIGN PATENT DOCUMENTS 8908139.0 12/1989 Germany .

*Primary Examiner*—Lincoln Donovan

*Attorney, Agent, or Firm*—Townsend & Townsend Khourie and Crew

[57] ABSTRACT

An electrical thick-layer fuse 10 and a method of manufacturing such a fuse is described. Here a conductive paste is printed onto a substrate 12 for the manufacture of a resistive layer 24. A dielectric layer 22 is however expediently first applied to the substrate in the manner of a podium to which the resistive layer 24 is then applied in overlapping manner. Two electrodes 14, 16 having a spacing d from one another are then applied onto this resistive layer 24, with a web of the resistive layer 24 forming a thick-film fuse being left between the two electrodes. The web width is set by laser treatment.

11 Claims, 5 Drawing Sheets

SIMULATION Dependence on b

THICK FILM FUSE AND METHOD FOR ITS MANUFACTURE

The invention relates to a method of manufacturing electrical thick-layer fuses having in each case one thick-layer fusible conductor arranged between two electrodes which is applied together with the electrodes onto a substrate. The invention relates furthermore to a thick-layer fuse manufactured in accordance with a method of this kind.

BACKGROUND OF THE INVENTION

Thick-layer fuses are distinguished from customary wire fuses primarily in that the wire-like fusible conductor is replaced by a thick-film fusible conductor. The manner of operation of a fuse of this kind also continues to lie in ensuring galvanic separation if a short circuit or if defined current overloading arises.

Problematic in the manufacture of such thick-layer fuses is first of all the maintenance of the tolerances which are set with regard to the fuse characteristics. This is made more difficult by the fact that the actual fuse behaviour can only be directly checked with respect to a respective thick-layer fuse when the destruction of a fuse occurs. Moreover, the respectively obtained fuse characteristics are dependent to a large degree in particular on the tolerance of the layer thicknesses and also on the tolerance which arises with respect to the width of the thick-layer fusible conductor. The maintenance of reproducible fuse characteristics is accordingly no longer straightforwardly possible when smaller fuse structures are to be realised.

SUMMARY OF THE INVENTION

The object of the invention is to provide a further method of the initially named kind through which in particular such predeterminable fuse characteristics, as for example the current/time behaviour, can be realised in a simple manner which can be reproduced as often as desired within a tolerance range which is as tight as possible. Furthermore, a thick-layer fuse should be provided which is manufacturable in this way and which has correspondingly predetermined characteristics.

The object is satisfied in accordance with the invention in that a resistive layer is generated on the substrate by printing on a conductive paste; in that the two electrodes are applied with a spacing from another preferably onto the resistive layer; and in that the width of a web of the resistive layer, which is left between the electrodes and forms the thick-layer fusible conductor, is set by laser treatment. A dielectric layer is preferably first applied to the substrate, i.e. formed on it, in the manner of a podium and the resistive layer which overlaps the dielectric podium is produced subsequently.

After the web width has been set by laser treatment, the respective fuse characteristics are also very accurately reproducible for relatively small web widths.

Precise structuring or shaping of the section of the resistive layer lying between the two electrodes is in any event possible by the laser treatment. As a result of the dielectric intermediate layer or layers, which is or are expediently provided between the substrate and the resistive layer, the disturbing thermal dissipation to the substrate can be substantially reduced, so that, as a consequence of the now given areal dissipation of the heat from the web fuse, the width of the web is now primarily responsible for the fuse characteristics, such as in particular the current/time behaviour.

As a result of the resistive layer which is applied in overlapping manner onto the dielectric podium, the respective fluctuations and thickness are reduced to a minimum, at least in the region of interest between the two electrodes. Since the electrodes are preferably applied onto the resistive layer, these electrodes have no influence on the manufacture of this layer, whereby the attainment of a surface resistance, which is as uniform as possible, is additionally made easier.

The resistive layer and/or the dielectric layer or dielectric layers are preferably applied by the screen-printing process, with the screen lying on the dielectric podium during the application of the resistive layer, so that practically the same force conditions arise as when printing larger areas in its inner region. Since the electrodes are subsequently applied to the resistive layer, disturbances of the gravure-print caused by the latter are in any event precluded.

For the manufacture of the web it is necessary in the simplest case to carry out two laser cuts lying in a common straight line. In order, however, to obtain a minimum degree of emphasis of the web in the direction of the electrode spacing, which is in any event not given by a simple laser cut, the relevant laser is preferably moved also in the longitudinal direction of the web over a corresponding path and is subsequently moved back, expediently parallel to the first cut, while forming a U-shaped cut. A U-shaped laser cut can in turn take place on both sides of the web, with the web length depending on the displacement of the laser which takes place in the web direction and also on the laser track width.

In a variant of the method which is particularly simple to carry out, the web width, which is obtained by laser treatment of the resistive layer, is directly set to a width value which is predetermined. Accordingly, an absolute beam positioning is provided which can for example be realised by a closed regulating circuit which receives the relevant desired value for the web width as a set value. Here the surface resistance of the resistive layer in the web region is assumed to be constant. This variant is in particular suitable for greater web widths, which lie for example above 80 $\mu$m.

For medium web widths, which for example include web widths of up to approximately 40 $\mu$m, the setting of the web width obtained by laser treatment of the resistive layer expediently takes place by a resistive compensation of the thick-layer fuse. Calibration lasers with direct regulation can, for example, be used for constant resistors. The target value for the resistor can either be calculated in advance, or could also be determined by tests.

For smaller web widths in particular, the web width to be set and/or the target resistance of a respective thick-layer fuse which results for the latter, is preferably determined in dependence on the surface resistance measured for the resistive layer region between the electrodes. This can be determined during the manufacture of the fuse web, for example by measuring the resistances of the respective thick-layer fuses which result for different initial web widths, with the surface resistance of the resistive layer region remaining between the electrodes being determined in dependence on the initially different web widths and the associated measured values of resistance.

The thick-layer fuse of the invention, which is in particular manufacturable by the described method, includes preferably at least one dielectric layer which is applied to the substrate with the uppermost layer in each case being built-up in podium-like manner and with a resistive layer being arranged in overlapping manner on this podium-like layer, with electrodes having a spacing d from one another being associated with the resistive layer and with a web of the resistive layer forming the thick-layer fusible conductor being left between said electrodes. The two electrodes are expediently applied to the resistive layer.

BRIEF DESCRIPTION OF THE DRAWINGS

The invention will be described in more detail in the following with reference to embodiments and to the drawing, in which are shown:

FIG. 6 is a plan view of the asymmetrical minimal arrangement for determining the surface resistance with the laser travel path drawn-in;

Figure 1:
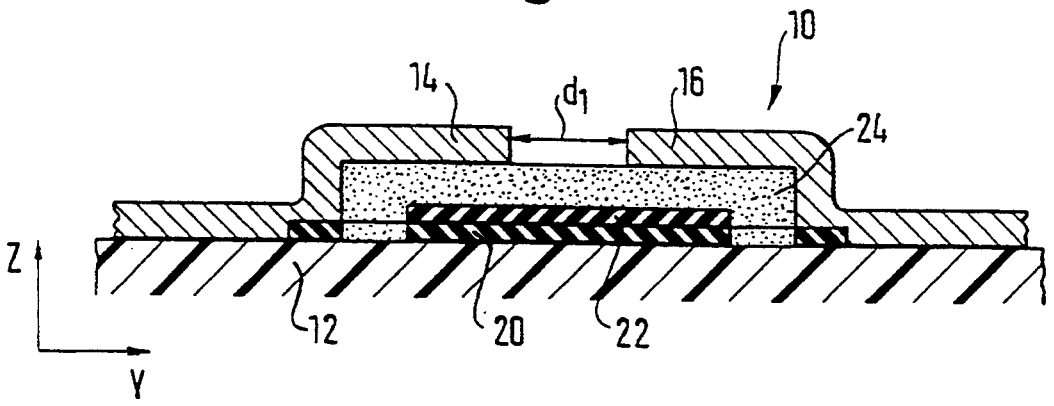
FIG. 1 is a schematic part-sectional illustration of the basic construction of a thick-layer fuse.

In accordance with the basic construction of a thick-layer fuse 10 as shown in FIG. 1, a dielectric layer 22 can be expediently applied in podium-like manner to a substrate 12. In the present case, a further dielectric layer 20 lying beneath layer 22 is also provided.

Figure 2:
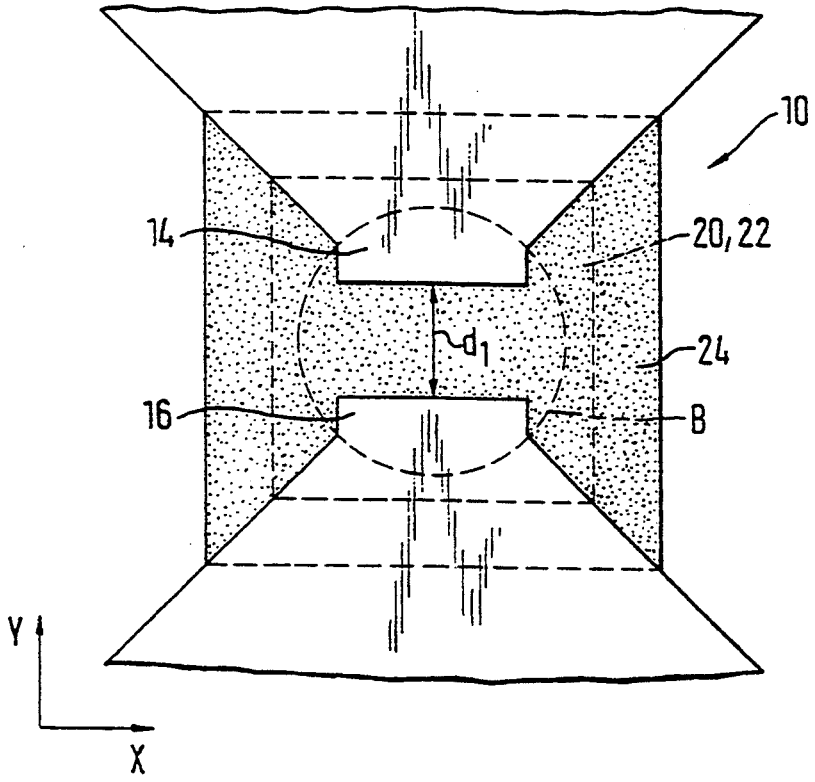
FIG. 2 is a schematic plan view of the thick-layer fuse shown in FIG. 1, with the fuse web which is to be provided between the two electrodes not yet having been realised.

A resistive layer 24 is arranged on the dielectric podium 22 and fully overlaps it over a large area. Two electrodes 14, 16 having a spacing d from one another are applied to the resistive layer 24. Both electrodes 14, 16, and also the neighbouring region B of the resistive layer 24 (see for example FIGS. 2 and 8) including the resistive region lying between these electrodes, lie above the dielectric podium 22.

In the finished thick-layer resistor 10 a fusible web 26 of the resistive layer 24 forming the thick-layer fusible conductor is left between the two electrodes 14, 16, and thus in a region above the dielectric podium 22 (see for example FIGS. 3, 4, 7 and 8).

Figure 3:
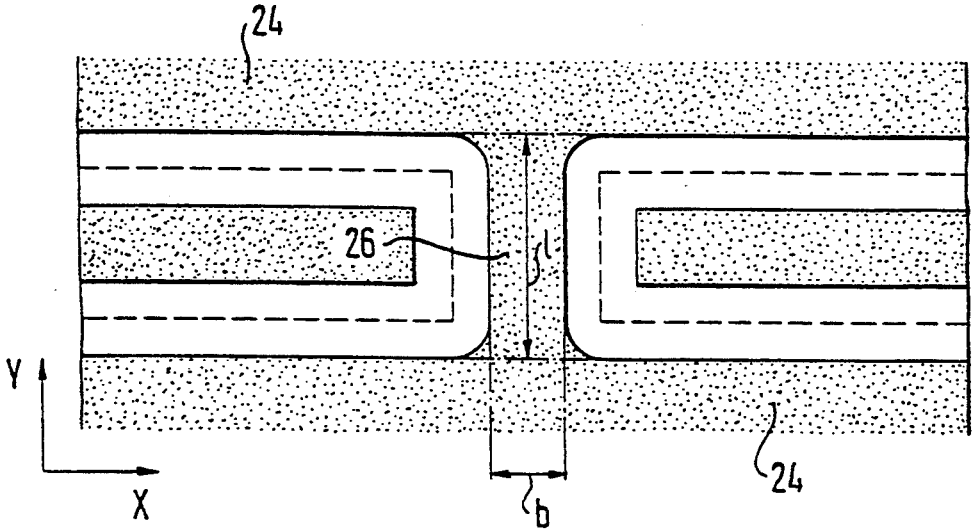
FIG. 3 is a schematic plan view of a fuse web of the resistive layer obtained by lateral laser cuts.
Figure 4:
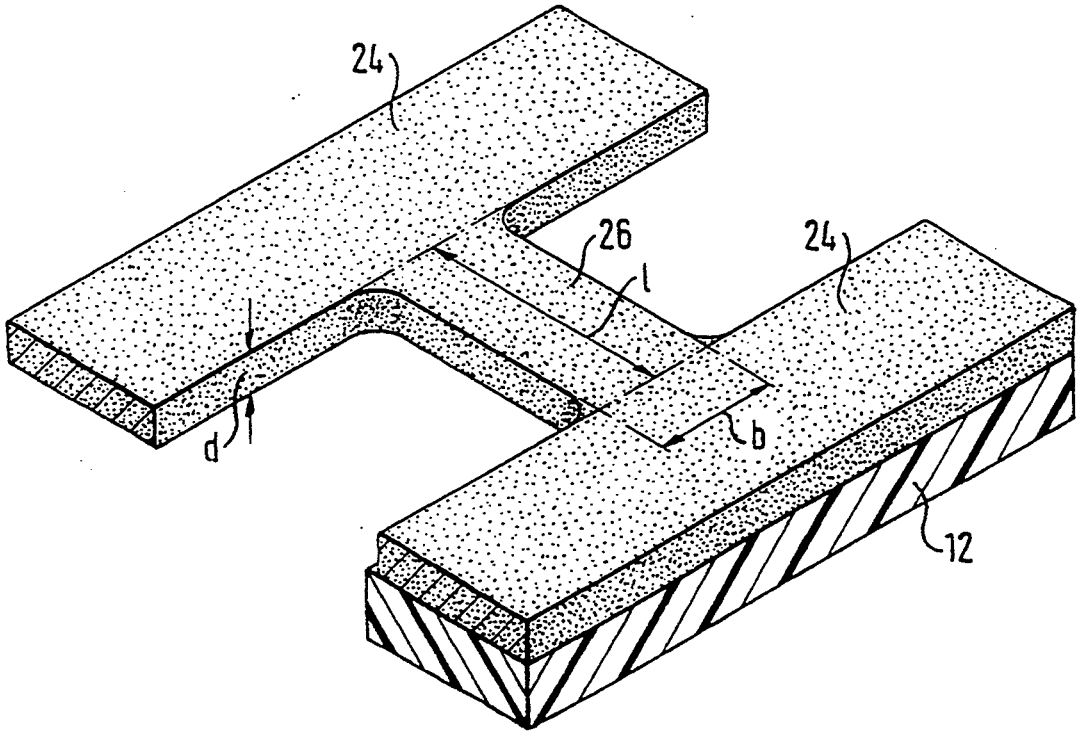
FIG. 4 is a perspective illustration of the web region.

The fuse web 26 lying between the two electrodes 14, 16 can have a length 1 which corresponds at least substantially to the spacing d of the two electrodes 14, 16 (see for example FIGS. 3, 4). This web length can however also be smaller than this electrode spacing d, as is for example the case in the embodiment illustrated in FIGS. 7 and 8.

For the manufacture of an electrical thick-layer fuse of this kind, the dielectric layer 20 is first applied and subsequently the dielectric layer 22 is applied in the manner of a podium. Basically, a single such layer 22 is however also sufficient, and for larger trigger currents a layer of this kind is indeed completely unnecessary.

Following this a conductive paste, which produces the resistive layer 24 which overlaps the dielectric podium 22 over a large area, is subsequently applied by printing.

The two conductors or electrodes 14, 16 are then applied to this resistive layer 24, with the spacing d being left between these two electrodes 14, 16 above the dielectric podium 22.

The two dielectric layers 20, 22 and also the resistive layer 24, which overlaps these over a large area, are respectively manufactured by the screen-printing process.

The width $b_{St}$ measured transverse to the spacing of the electrodes 14, 16 (see FIGS. 3, 4, 7 and 8) of the web 26 of the resistive layer, which is left between the electrodes 14, 16 and forms the thick-layer fusible conductor, is set by laser treatment. During this the resistive layer 24 is structured by corresponding laser cuts which are illustrated in FIGS. 3, 6 and 7 by broken-line paths in a manner which has yet to be described.

In carrying out these laser cuts, the web width $b_{St}$ can for example be directly set to a specific width value in advance (see for example FIGS. 3, 4).

The setting of the web width $b_{St}$ of the web width obtained by laser treatment of the resistive layer 24, can however also take place by resistance adjustment or calibration of the thick-layer fuse.

Figure 6:
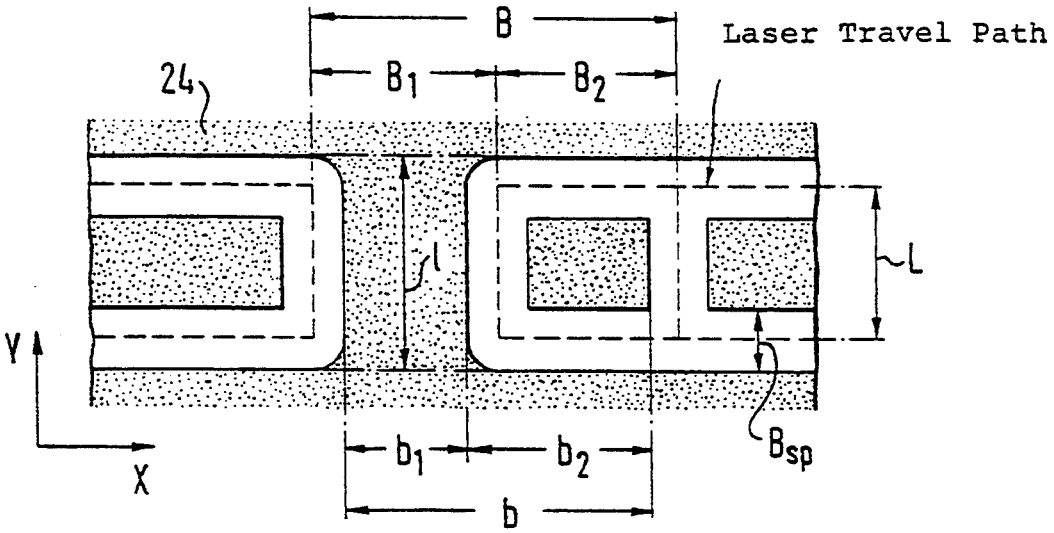
Figure 8:
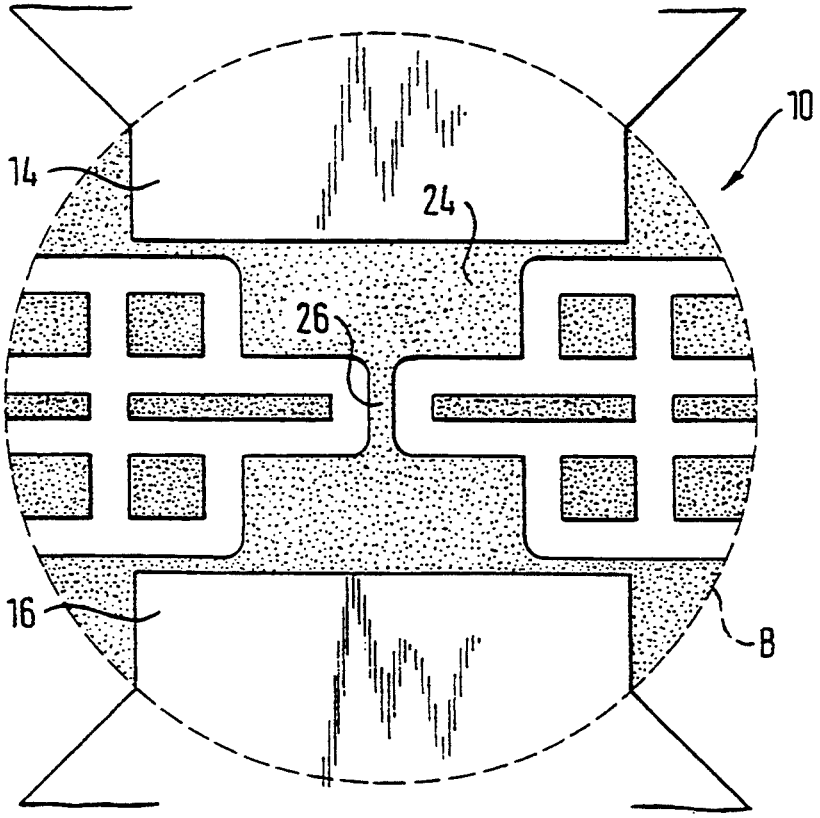
FIG. 8 is a plan view of the thick-layer fuse corresponding to the FIGS. 2 and 7, with a fuse web already having been realised by corresponding laser structuring and with the width of the web being set in dependence on the previously determined surface resistance.
Figure 7:
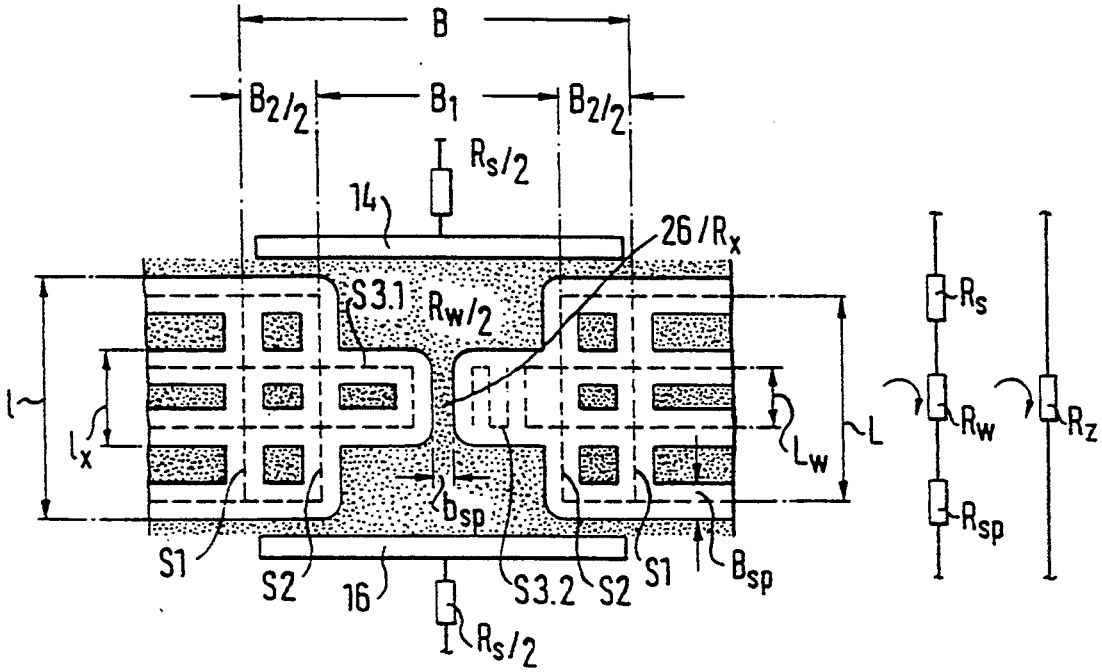
FIG. 7 is a purely schematic illustration of the cut lines, or laser travel paths which result for an $R_F$ determination in accordance with FIG. 6, and also for the subsequent manufacture of the fuse web of FIG. 3, with however a symmetrical embodiment of the cuts being selected in deviation from the embodiment of FIG. 6.

Finally, the web width $b_{St}$ to be set and/or the target resistance $R_z$ which result for the latter for a respective thick-layer fuse 10 can also be determined in dependence on the surface resistance $R_F$ for the resistive layer zone between the electrodes 14, 16 (see for example FIGS. 6 to 8).

In accordance with FIGS. 6, 7 and 8 provision is for example made, in order to determine the surface resistance, to measure the resistances of the thick-layer fuse which result for different initial web widths, and then to determine the surface resistance of the resistive layer zone remaining between the electrodes in dependence on the initially differing web widths, or the corresponding laser travel paths, and also the associated measured resistive values. In the embodiment shown in FIGS. 7 and 8 the webs, which are initially generated to determine the surface resistance, have a greater length than the final web which forms the thick-film fusible conductor.

The electrodes 14, 16 which are aligned with one another have the same defined geometry, i.e. in particular the same width and longitudinal edges which extend parallel to one another and bring about a constant spacing d. Through the illustrated shape of the electrodes it is in particular also ensured that, at the time of effecting a laser structuring within the surface zone in which the fuse web is to be realised, an electrical field strength can be generated which is as homogenous as possible.

The initially named method steps of setting a constant web width through absolute positioning of the laser beam, of setting a constant web resistance and also of setting an individual web width, which can be computed in dependence on the local surface resistance in the region of the fuse web to be manufactured, can also be combined with one another. Thus, it is for example possible to set the starting values for the two other method steps by absolute positioning of the laser beam.

In order to avoid droplet-like melting of the paste in the web region during laser structuring, the laser cuts are expediently split-up into partial cuts between which there is in each case a waiting period and the laser is switched off.

In the illustrated thick-layer fuses, the trigger time is not dependent on the web length. The determining factor for the fuse characteristics to be realised is primarily the current/time behaviour which is predominantly determined by the web width. This can be seen, for example, from the following energy balance $$Q_E = Q_N + Q_A,$$

with $Q_E$ describing the electrical energy fed into the fuse which is split-up into the useful energy $Q_N$ which is required to heat-up the fuse web to the fusing temperature $T_s$ and for the subsequent melting thereof, and also the dissipated heat $Q_A$ which flows during this time to the substrate 12 consisting of ceramic.

Beneath a critical trigger current strength $I_O$ an equilibrium can set in between the electrical energy which is supplied and the thermal energy which flows away. Only for current values $I > I_O$ is the fusing temperature $T_s$ of the fusible web attained at which the latter can melt, whereby the galvanic separation arises.

The trigger time t results from the following relationship:

$$t = \frac{b_{St} d A}{\frac{\rho_R}{b_{St} d} I^2 - b_{St} B} \quad \text{(I)}$$

$b_{St}$ = web width
d = thickness of the resistive layer
A = material constant
$\rho_R$ = specific resistance
I = current
B = material constant Thus the following relationship results for the web width $b_{St}$ which is to be set:

$$b_{St} = I \sqrt{\frac{\rho_R / d}{A \frac{d}{t} + B}} \quad \text{(II)}$$

In general an arrangement which is of the lowest ohmic resistance possible is preferred for the thick-film fuse. The small structures which are necessary for the correspondingly small trigger currents can be relatively precisely manufactured by corresponding laser cuts.

The simplest possible fuse structure would consist of two laser cuts which run towards one another on a straight line. In order to preclude eventual scatter of the triggering time as a result of undefined web widths, a minimum degree of emphasis of the web in the direction of the electrode spacing is however expediently provided. This is, for example, attained in the FIG. 3 in that the laser is preferably displaced by twice the laser track width in the Y-direction, i.e. in the direction of the electrode spacing. The fusible web 26 is accordingly generated by U-shaped laser cuts which are effected on both sides, with the web length 1 being determined by the X-displacement and also by the laser track width. Through the web extension a reliable galvanic separation after melting is also ensured amongst other things.

In accordance with the above quoted relationship the trigger time t is dependent on the layer thickness d and the specific paste resistance $\rho_R$ of the fusible web. These values must accordingly either be assumed to be constant, or individually determined for each individual web.

In the event of an individual determination of the said parameters for each individual web these can, for example, be indirectly obtained via a measurement parameter which includes both information on the layer thickness and also information on the specific resistance. Here, the surface resistance $R_F$ in particular is of interest, which is defined by the following relationship:

$$\frac{\rho_R}{d} = R_F = R_{X1} = \frac{b_1}{l} \quad \text{(III)}$$

with 1 and $b_1$ in each case being constant.

Whereas the trigger time t is dependent both on the material constant A and also on the constant B, the trigger current $I_O$ is only dependent on one of these two constants, and indeed on the constant B. This results from the following relationship:

$$I_0 = b_{St} \sqrt{\frac{B}{R_F}} \quad \text{(IV)}$$

As a result of this relationship it is possible to keep the trigger current $I_O$ Constant independent of respective fluctuations of the specific paste resistance $\rho_R$ and the layer thickness d.

The respective fuse characteristics and in particular the respective current/time behaviour of the thick-layer fuse can now be set in different manners. Thus, for example, a constant web width, a constant web resistance or a constant trigger current can be set.

By way of example the travel paths are shown in FIG. 3 for a respective laser which result with absolute beam positioning for the setting of a constant web width $b_{St}$. This is achieved by two lateral U-shaped laser cuts, with the respective laser again also being displaced in the Y-direction in order to obtain the minimum degree of web emphasis which is required for a defined web width.

Before the constant web width is set by corresponding absolute beam positioning, the web width is, in this embodiment, determined once in advance. This can, for example, take place by tests, or by a calculation starting from a desired trigger current $I_O$, a surface resistance which is assumed to be constant and also the constant B which is assumed to be known. As a result of the generation of a resistive layer overlapping the dielectric podium, the paste surface resistance $R_F$ in the web zone of interest can be kept at an almost constant value without problems.

With this setting of a constant web width through absolute beam positioning, it is furthermore assumed that the layer thickness b (see for example FIG. 4) does not vary either within the useful substrate nor within one printing batch. So far as possible no fluctations of the paste surface resistance $R_F$ and of the printing behaviour should occur between different printing batches.

Figure 5:
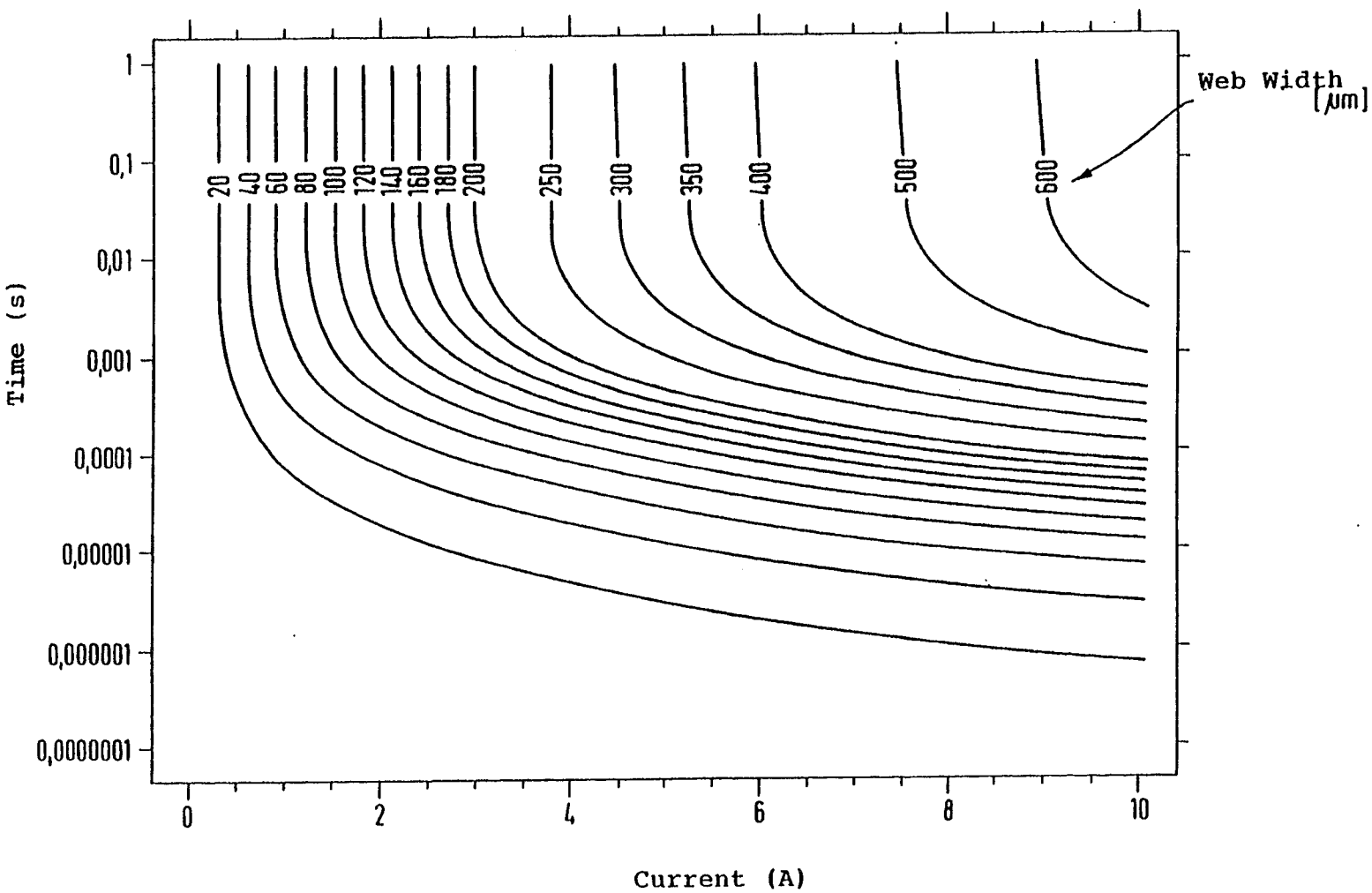
FIG. 5 is a current/time diagram to illustrate the relevant fuse characteristics in dependence on the web width.

The typical current/time behaviour of the thick-layer fuse is shown in FIG. 5 in dependence on the respective web width $b_{St}$, with the trigger currents $I_O$ in each case being defined by the vertical sections of the different curves.

The melting time or trigger time is shown as a function of the excess current. Here, the respective characteristic runs in a first region for small fault currents and large melting duration almost perpendicular to the current axis. In this region even the smallest changes in current lead to a relatively large variation of the melting duration. In a second region, the respective plots are strongly curved. Finally in the third region these plots become horizontal. The reason for this lies, amongst other things, in the fact that in this third region, the thermal dissipation to the environment can be ignored.

With respect to FIG. 6 it can be seen how the laser must be moved in order to determine the individual surface resistance $R_F$ of the web region for a particular thick-layer fuse.

Here, the laser is first moved sufficiently far that an initial web width b arises. For this initial web width b, the total resistance $R_1$ of the overall arrangement is measured. A further laser cut is then carried out, whereafter the web width $b_1$ is obtained for which again the total resistance $R_2$ of the arrangement is measured. The track width of the laser is $B_{Sp}$.

After the first resistance measurement the laser is displaced through the distance $B_2$ in the X-direction. The respective spacing measured from centre to centre of the two laser displacement paths provided in the longitudinal direction of the web amounts initially to B and subsequently to $B_1$, with $$B=B_1+B_2.$$

Accordingly, the initial web width b can be represented as follows:

$$b=b_1+b_2.$$

The initially obtained web with the width b has a web resistance which can be represented by two resistances $R_{X1}$ and $R_{X2}$ connected in parallel. For the web with the width $b_1$ which results after the laser displacement $B_2$ there results a web resistance $R_{X1}$, which signifies that with this auxiliary cut the parallel auxiliary resistance $R_{X2}$ was removed. The web length l is hereby kept constant. L designates the travel path of the laser in the longitudinal direction of the web.

The measured overall resistances $R_1$, $R_2$ are however not only determined by the respective web resistances, but rather additionally also by resistances which lie in series therewith, which for example include the conductor resistances and also the transition resistances in the region of the bonds to the conductors. The series resistance $R_S$ which in each case lies in series with the web resistances $R_{X1}$, $R_{X2}$ can be eliminated for $R_{X1}=t\ R_{X2}$ by the following relationships:

$$R_{X1}=(1+1/t)\,(R_2-R_1)$$

$$R_S=R_2-R_{X1} \qquad \text{(V)}$$

The surface resistance $R_F$ which is sought for the relevant web zone of the resistive layer accordingly results from the following relationships:

$$R_{X1}=R_F\frac{1}{b_1} \qquad R_{X2}=R_F\frac{1}{b_2} \qquad \text{(VI)}$$

$$\frac{R_{X1}}{R_{X2}}=t=\frac{b_2}{b_1} \qquad \text{(VII)}$$

The web resistance $R_{X1}$ for the web of the width $b_1$, which results after the laser displacement $B_2$, can be represented as follows in dependence on the two measured overall resistances, the width $b_1$, $b_2$ of the two webs which lie initially parallel to one another and the sum width b:

$$R_{X1}=(R_2-R_1)\left(1+\frac{b_1}{b_2}\right) \qquad \text{(VIII)}$$

$$R_{X1}=(R_2-R_1)\frac{b}{b-b_1}$$

Transferred to the control parameters for the laser travel paths this signifies that:

$$b=B-B_{SP}$$

$$l=L+B_{SP}$$

$$b_1=B_1-B_{SP}$$

$$b_2=B_2 \qquad \text{(IX)}$$

from which it follows that:

$$R_{X1}=(R_2-R_1)\frac{B-B_{Sp}}{B_2} \qquad \text{(X)}$$

$$R_S=R_2-R_{X1}$$

$$R_F=R_{X1}\frac{b_1}{l}=R_{X1}\frac{B_1-B_{Sp}}{L+B_{Sp}}$$

Accordingly, the surface resistance for the web zone which is of interest can be determined in the course of the laser structuring which must in any case be effected in that the total resistances are measured for two different web widths and the value of the surface resistance is computed from the resistive values that are obtained and also from the relevant laser travel paths.

The surface resistance in particular, which is derived in this manner, can be used to compute the web width which has to be set and/or to compute a target resistance of a respective thick-layer fuse which results for this web width.

For the setting of a constant web resistance, it is also in turn important to realise a fuse web which is as clearly geometrically defined as possible. For this purpose, laser cuts are again preferably executed, such as are described in conjunction with FIG. 3. Here the web length l has a preset size.

For an adjustment of this kind to a constant resistance R, the quotient $\rho_R/b_{St}d$ is kept constant, which in particular signifies a constant product $b_{St}d$ for a constant parameter $\rho_R$. Both the time/current characteristic t=F (I) and also the trigger current $I_O$ thus remain independent of fluctuations of the layer thickness d and of the specific paste resistance $\rho_R$. A scatter of these parameters can however be kept within at least narrow limits, by the described manufacturing method.

Instead of computing the target resistance in advance, this can also be found by tests.

In the embodiment shown in FIGS. 7 and 8, a setting to a constant trigger current $I_O$ takes place with use being made of the relationship $$b_{St} = I_0\sqrt{\frac{R_F}{B}} \quad \text{(XI)}$$

and with the surface resistance $R_F$ being determined in the course of the laser structuring which is carried out in the manner previously described, with the target resistance $R_Z$ for the final setting being then in turn computed from the surface resistance $R_F$.

Accordingly, an individual surface resistance $R_F$ is first determined which is associated with the respective thick-layer fuse, from which, for a desired given constant trigger current $I_O$, an individual web width $b_{St}$ is computed. The value for the individual web width is subsequently converted into an individual target value $R_Z$ for the resistance setting to be brought about by the laser treatment.

In order to be able to exactly determine the target value $R_Z$, the parasitic series feedline and contact transition resistances must be precisely known. In order to correspondingly take account of these feedline and contact transition resistances, two additional laser cuts are carried out as has already been described in connection with FIG. 6. From the total resistances $R_1$, $R_2$ measured for the two different web widths, both the series resistance $R_S$, determined by the feedline and contact transition resistances, and also the surface resistance $R_F=\rho_R/d$ can be individually determined for each web.

The web length l is expediently preset by the layout of the bonding to the conductive tracks.

First of all, a first laser cut S1 is effected on both sides of the web to be manufactured and leads to an initial web width corresponding to the width of the electrodes 14, 16. For this initial web width there results a spacing B of the respective laser travel paths S1 measured from centre to centre. For the initial web, which is obtained in this manner, the total resistance $R_1$ is measured.

Thereafter, a second laser cut S2 is executed from one side or from both sides of the web which leads to narrowing of the web by $B_2$ and also has a U-shaped course as does the first cut S1. For both cuts S1 and S2 there respectively results a web length 1 which is approximately the same as the spacing between the two electrodes 14, 16. For the web which is now obtained, for which a spacing $B_1$ of the two laser travel paths S2 results as measured from centre to centre, the total resistance $R_2$ of the arrangement is in turn measured.

Starting from the two measured resistance values, the series resistance $R_S$ determined by the feedline and contact transition resistances can then be determined with reference to the relationship V. Furthermore, the individual surface resistance $R_F$ can be determined from the relationship X. Subsequently, the individual web width $b_{St}$ is determined with reference to the relationship XI and from this the individual target resistance $R_Z$ can be calculated via the following relationship:

$$R_Z = R_S + R_W + R_{St} \quad \text{(XII)}$$

with

-continued $$R_{St} = R_F\frac{L_{St} + B_{Sp}}{b_{St}} \quad \text{(XIII)}$$

and $$R_W = R_F\frac{L - L_{St}}{B_1 - B_{Sp}} \cdot K \quad \text{(XIV)}$$

with K: being a geometry factor (current density distribution).

Following this, a further laser cut S3.1 is for example produced at the left-hand side of the web 26 to be manufactured which already specifies the final web length $l_{St}$ which can be smaller than the length l equal to the spacing between the two electrodes 14, 16. With this laser cut S3.1 carried out on the left-hand side, a web width determined in advance can preferably be set.

Subsequently, a further laser cut S3.2 is manufactured on the right-hand web side while maintaining the same web length $l_{St}$, and this is carried out by way of a calibration with the target resistance $R_Z$.

The conductive paste, which is used for the manufacture of the resistive layer, can be a resistive paste and also a conductor track paste.

In all variants, the thick-layer fuse can subsequently be provided with a cover (cover layer).

Thus a fuse element with non-reversible fuse function and manufacturable in thick-layer technology can be provided which, without penalties with regard to the respective fuse characteristics, can be manufactured at a favourable price in miniature form, can be integrated into thick-layer hybrid circuits, and can also be realised as a chip component. The respective trigger current is settable with the highest degree of accuracy. Through the special basic construction layer thickness scatter is, in particular, reduced to a minimum. As a result of the laser structure which is carried out even the most extremely narrow webs can be manufactured with the highest degree of accuracy, so that with uniform layer thickness smaller resistive values of the fuses can likewise also be realised.

We claim:

1. Method of manufacturing electrical thick-layer fuses having:

providing a supporting substrate;

placing a thick-layer fusible conductor on said substrate generated on the substrate by printing on a conductive paste;

placing two electrodes supported on said substrate extending over said thick-layer fusible conductor, said two electrodes applied with a spacing from one another preferably onto said thick-layer fusible conductor;

the improvement to said process including the step of:

forming the width of the thick-layer fusible conductor relative to said electrodes by laser ablation of said thick-layer fusible conductor to form a resistive path under said electrodes whereby a fuse of known tolerance to current flow is formed.

2. Method in accordance with claim 1, including the steps of:

applying a dielectric layer to the substrate in a flat elevated podium like layer; and forming the thick-layer fusible conductor to overlap said dielectric layer.

3. Method in accordance with claim 1, including the steps of:

applying said thick-layer fusible conductor by the screen-printing process.

4. Method in accordance with claim 2, including the steps of:

applying said dielectric layer by the screen-printing process.

5. Method in accordance with claim 1, including the steps of:

selecting the web length to be at least substantially the same as the electrode spacing.

6. Method in accordance with claim 1, including the steps of:

selecting the web width obtained by laser ablation of the thick-layer fusible conductor is directly set to a predetermined width value.

7. Method in accordance with claim 1, including the steps of:

calibrating the thick-layer fuse individually for each fuse; and, setting of the web width obtained by laser ablation of the thick-layer fusible conductor is set to a value determined by said calibration.

8. Method in accordance with claim 1, including the steps of:

determining the surface resistance for the thick-layer region between the electrodes; and, setting the web width dependent upon said determined surface resistance.

9. Method in accordance with claim 1, including the steps of:

measuring the surface resistance resulting from different initial web widths; and, determining the surface resistance of the resistive path remaining between the electrodes from said measured initial web widths.

10. Method in accordance with claim 1, including the steps of:

choosing the initial width of the applied thick-layer fusible conductor in accordance with the width of the electrodes; and, providing to said electrodes the same geometrical form as said fusible conductor.

11. A thick-layer fuse with a thick-layer fusible conductor arranged between two electrodes with the thick-layer fuse being applied onto a substrate together with the electrodes comprising:

at least one dielectric layer is applied to the substrate with the uppermost layer in each case being built-up in podium-like manner;

said thick layer fusible conductor being arranged in overlapping manner on this upper most layer;

said electrodes having confronting edges overlying said dielectric layer with a constant a spacing from one another;

said thick layer fusible conductor being formed with a web of controlled width forming the thick-layer fusible conductor between said electrodes for obtaining precision tolerance of current flow restriction.

* * * * *